US005987274A

United States Patent [19]

Satoh

[11] Patent Number: 5,987,274

[45] **Date of Patent: *Nov. 16, 1999**

[54] IMAGE RECORDING APPARATUS AND METHOD WHICH CONTROLS THE FIXING TEMPERATURE

[75] Inventor: Kazuhiro Satoh, Hiratsuka, Japan

[73] Assignee: Ricoh Company, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/852,683

[22] Filed: May 7, 1997

[30] Foreign Application Priority Data

May 8, 1996 [JP] Japan ..... 8-137577

[51] Int. Cl.[6] ..... G03G 15/20

[52] U.S. Cl. ..... 399/69; 399/67

[58] Field of Search ..... 399/67, 69, 70; 219/216

[56] References Cited

U.S. PATENT DOCUMENTS

| | | | |
|---|---|---|---|
| 4,745,436 | 5/1988 | Matsuura | 399/70 |
| 5,241,349 | 8/1993 | Nagasaka | 399/70 |
| 5,475,475 | 12/1995 | Kohtani et al. | 399/79 |
| 5,489,935 | 2/1996 | Dornier | 347/211 |
| 5,528,346 | 6/1996 | Kim et al. | 399/33 |

FOREIGN PATENT DOCUMENTS

| | | |
|---|---|---|
| 1-133069 | 5/1989 | Japan . |
| 1-284886 | 11/1989 | Japan . |
| 4-353887 | 12/1992 | Japan . |
| 4-358171 | 12/1992 | Japan . |
| 5-273813 | 10/1993 | Japan . |
| 6-282127 | 10/1993 | Japan . |
| 5-323710 | 12/1993 | Japan . |
| 7-319371 | 12/1995 | Japan . |

*Primary Examiner*—Matthew S. Smith

*Attorney, Agent, or Firm*—Oblon, Spivak, McClelland, Maier & Neustadt, P.C.

[57] ABSTRACT

An image forming apparatus and method for controlling the temperature of a fixing device. When any key of the image forming apparatus is pressed, the temperature of the fixing device is raised from a normal waiting temperature to a high waiting temperature. Alternatively, only when a key related to an image forming operation is pressed is the temperature of the fixing device raised to the high waiting temperature. At the high waiting temperature, when a command is given to perform an image forming operation, the temperature of the fixing device is raised to the fixing temperature and after the image forming operation and the fixing operation is completed, the temperature of the fixing device returns to the high waiting temperature. The temperature of the fixing device is lowered from the high waiting temperature to the normal waiting temperature after a predetermined period during which there are no image forming operations performed and no keys are pressed. As an alternative, the temperature is lowered from the high waiting temperature to the normal waiting temperature when a key related to the image forming operation is not detected and no image forming operation has occurred. A key related to an image forming operation include keys for starting and controlling the image forming operation and also keys for setting the parameters of the image forming operation such as a key to control the density of the printed image, and a key to control the number of copies which are made.

32 Claims, 11 Drawing Sheets

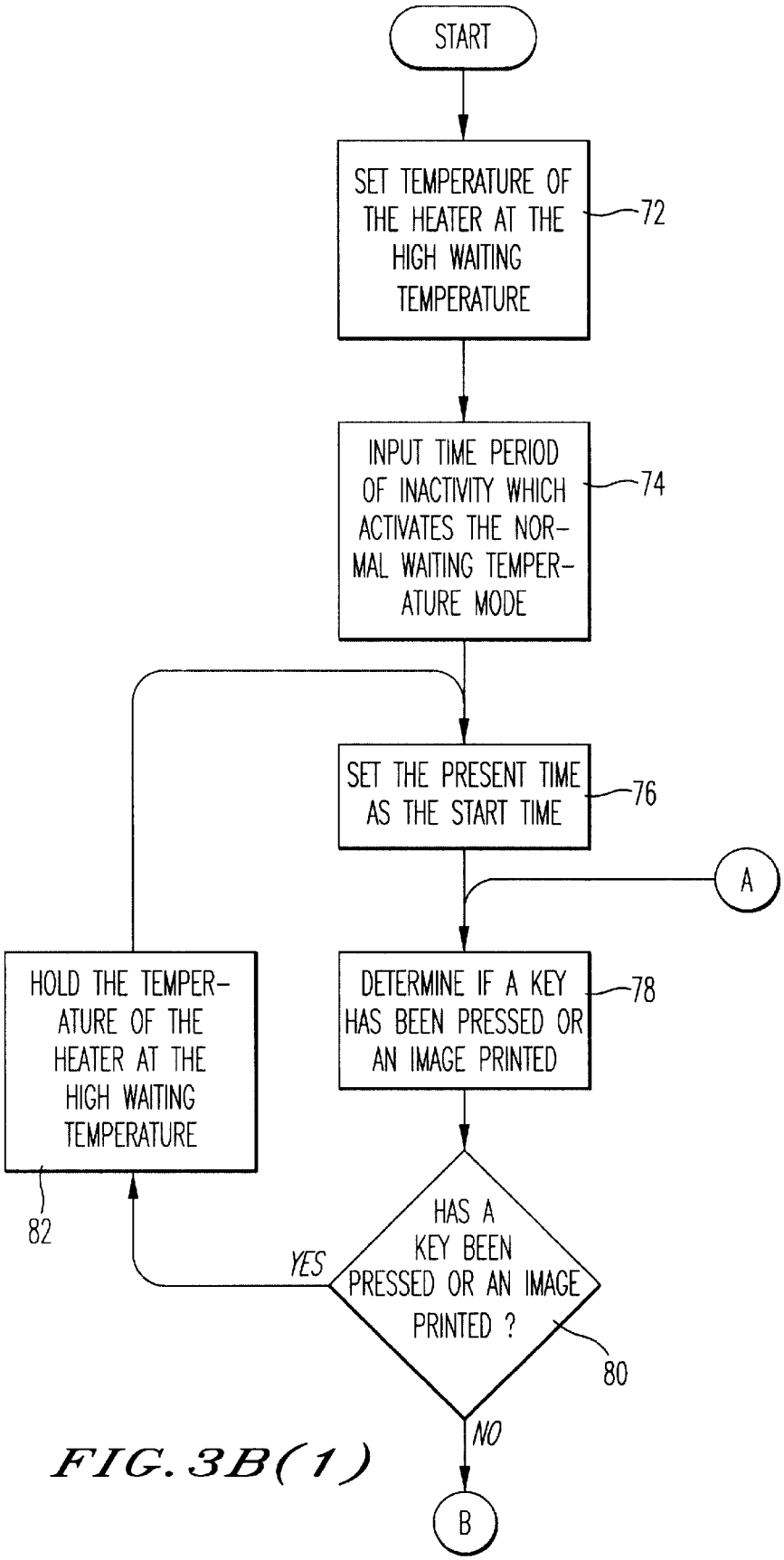
FIG. 3B(1)

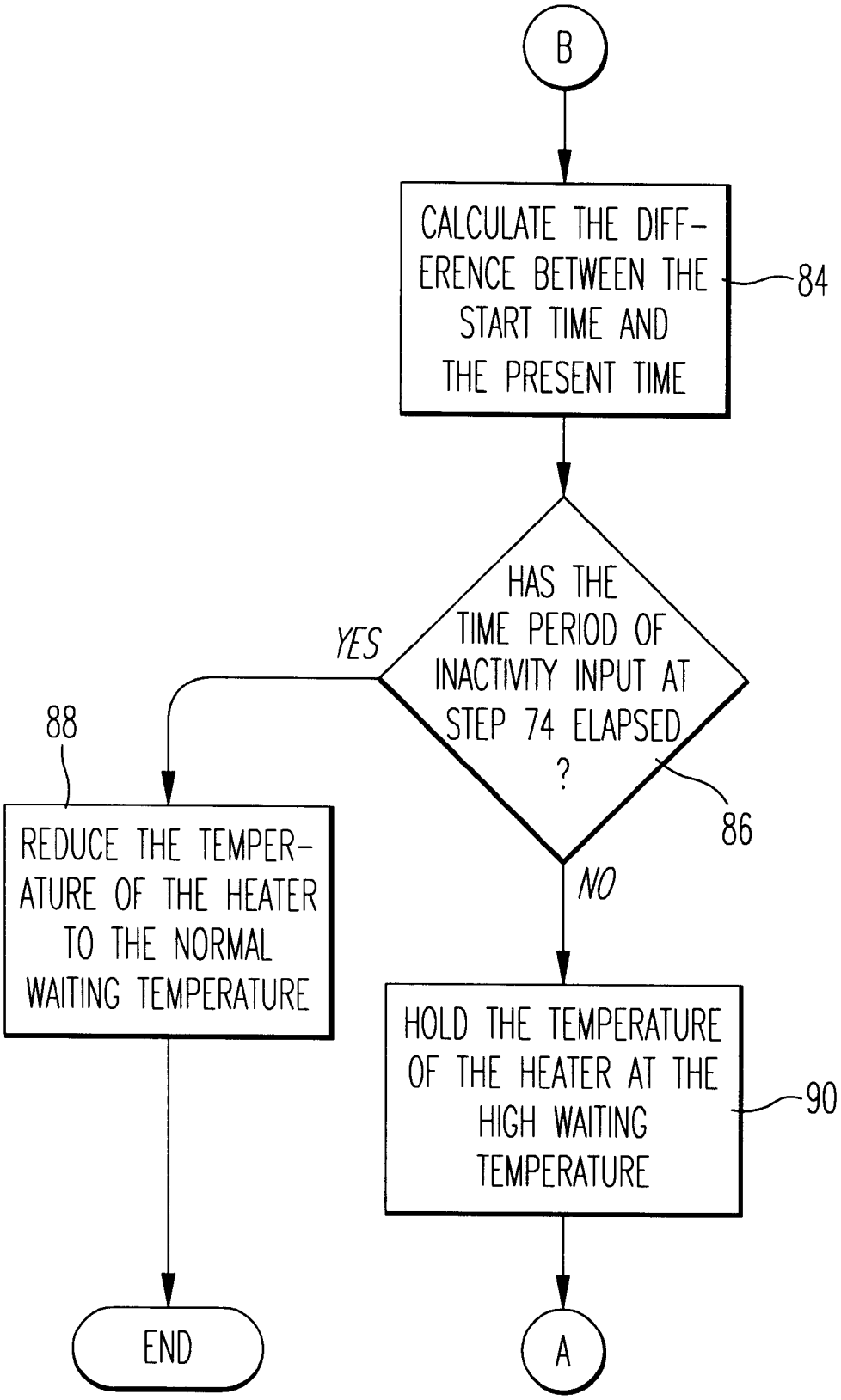
FIG. 3B(2)

FIG. 5B(1)
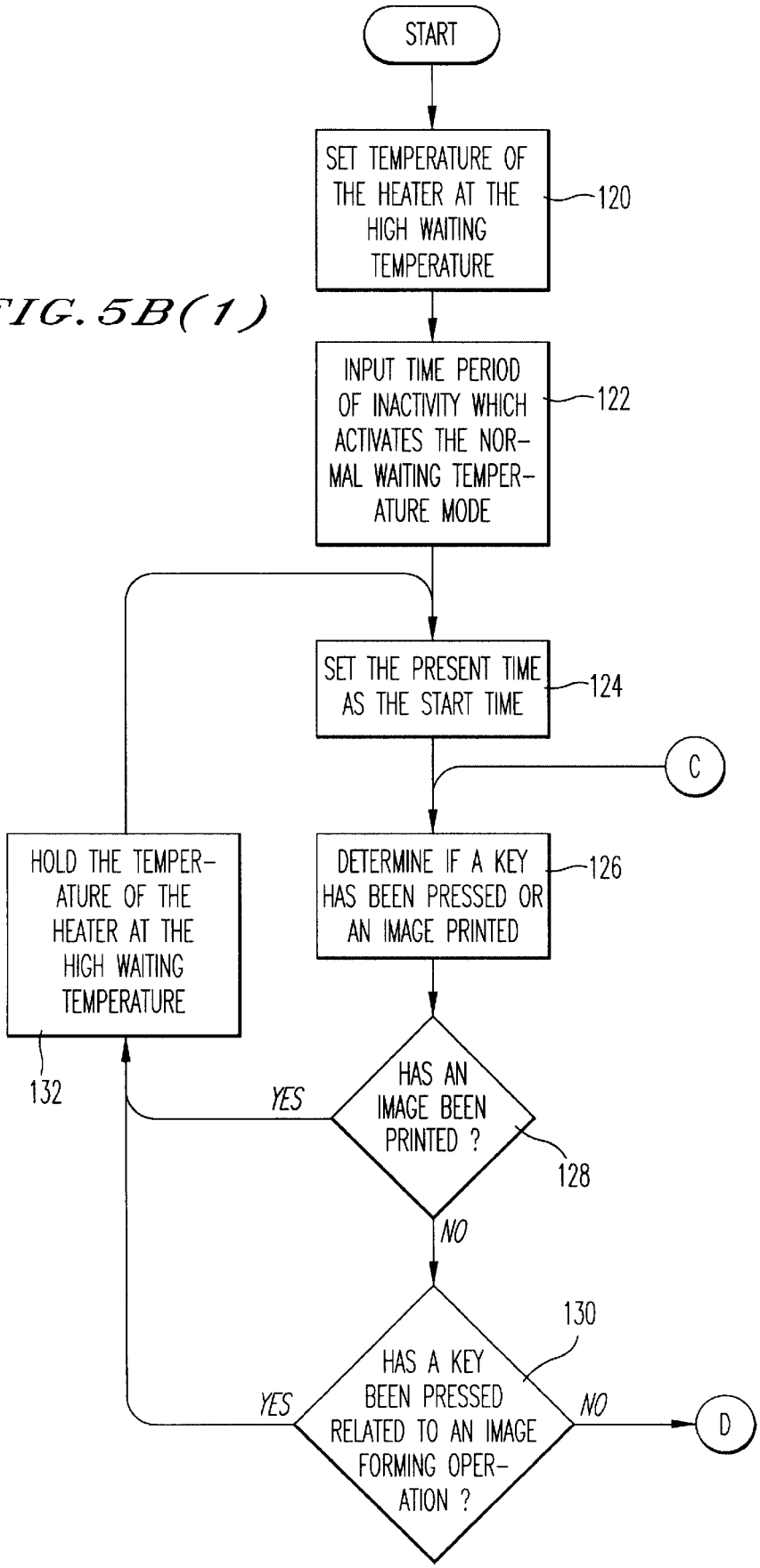

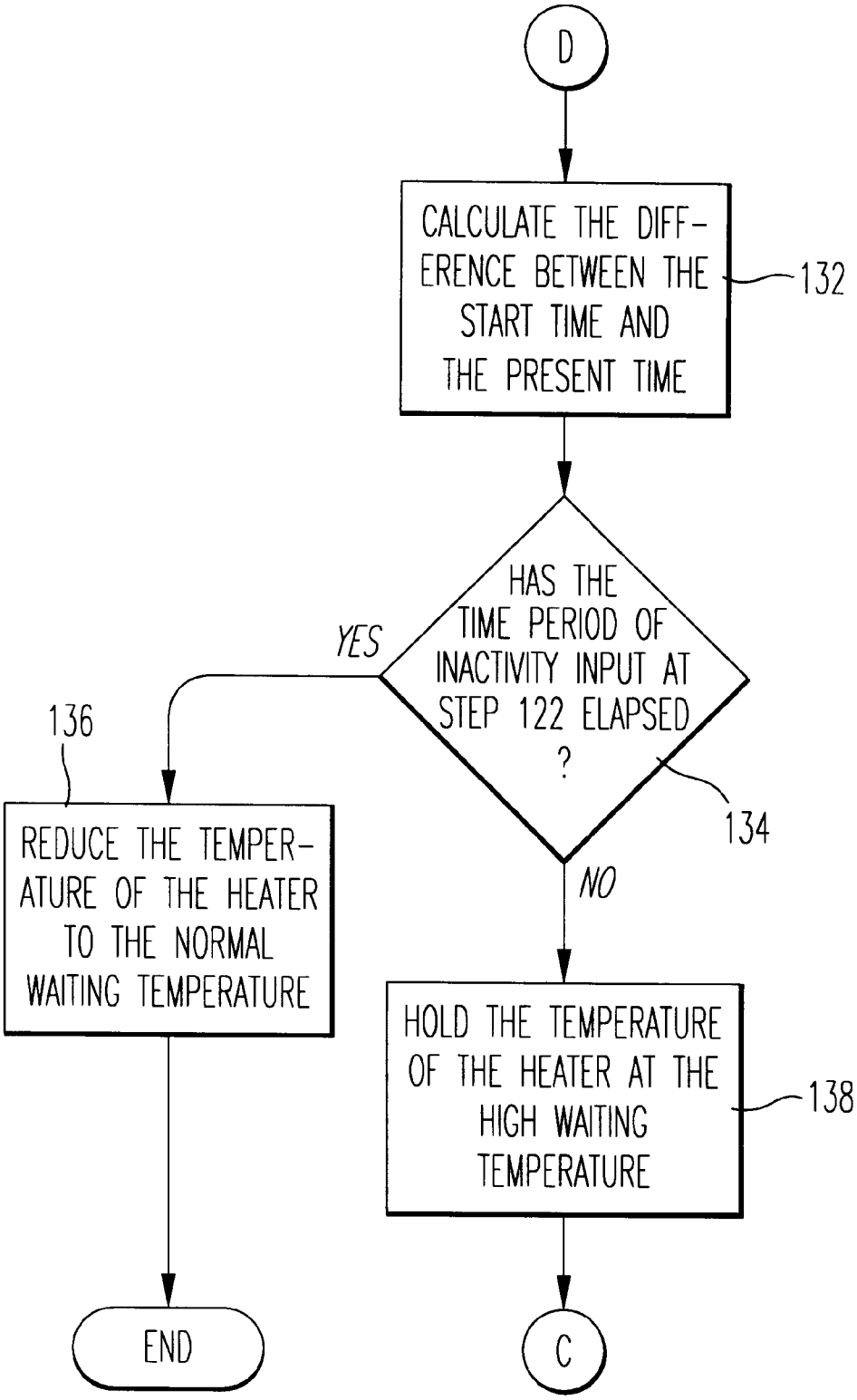
FIG. 5B(2)

IMAGE RECORDING APPARATUS AND METHOD WHICH CONTROLS THE FIXING TEMPERATURE

BACKGROUND OF THE INVENTION

1. Field of the Invention

This invention relates to an image recording apparatus having a heated fixing device used in a facsimile machine, a copier, a printer of a multifunction printing apparatus. This invention more specifically relates to an image recording apparatus in which it is possible to change the temperature of the fixing roller heater for saving electric power in a multifunction device.

2. Discussion of the Background

In general, an electro-photographic image recording apparatus is used in a facsimile machine, a copier or other printing apparatus. The image recording apparatus has a heated roller for fixing a toner image on recording paper. That is to say, it supplies electric power to the heated fixing roller and raises the temperature thereof to the fixing temperature. The heated roller then fixes the toner image on the paper.

In order to properly fix the toner image on the paper, it is necessary to hold the temperature at the heated roller at the fixing temperature. However, holding the fixing heated roller at the temperature when not performing a fixing operation consumes unnecessary electric power and raises the temperature of the apparatus. Therefore, in a conventional system, the image recording apparatus holds the fixing roller at a preliminary temperature which is lower than the fixing temperature, starts to raise the fixing roller temperature to the fixing temperature before fixing, and is set to the fixing temperature when fixing. For example, in the case of a facsimile apparatus, the temperature of the fixing roller begins rising at the time of detecting a ring signal.

In a copier shown in the patent specification of Japanese patent application laid-open (KOKAI) No. 1-284886, the temperature of the heated roller is ordinarily set to a low temperature. The temperature of the fixing roller is set to a higher temperature upon detection of opening the cover of the glass platen. A predetermined time after copying, the heated roller used for fixing is set to a low temperature.

However, the above mentioned technique of controlling the fixing temperature in a conventional copier is not effective in a facsimile machine because the roller temperature starts to rise from the preliminary temperature to the fixing temperature when the ring signal is detected. Therefore, the conventional technique shown in the patent specification of Japanese laid-open patent application (KOKAI) 1-284886 is only effective in a copier in which the fixing temperature is raised upon opening the cover and setting a sheet of paper on the glass platen.

SUMMARY OF THE INVENTION

Accordingly, it is an object of this invention is to provide an image forming method and apparatus which controls the fixing temperature. It is a further object of the invention to provide an image forming method and apparatus which controls the fixing temperature so that the fixing temperature is lowered when the appropriate conditions exist. It is a further object of the invention to provide an image forming method and apparatus which raises the fixing temperature when appropriate conditions exist.

These and other objects are accomplished by an image forming apparatus constructed in accordance with the present invention which appropriately controls the fixing temperature. The image forming apparatus may be implemented as any type of image forming device such as a copier, printer, facsimile machine, or a multifuntion machine. The image forming device includes a user interface for receiving commands from and displaying information to a user, and image forming device which includes a fixing device. The fixing device is preferably implemented using a heated roller and a temperature sensor. The heating element is either incorporated within the heated roller or alternatively is separate from the heated roller. A controller is utilized to control the operation of the image forming device.

According to the first embodiment of the invention, when a user presses any key, the fixing device goes from a normal waiting temperature to a high waiting temperature. The normal waiting temperature is a low waiting temperature of approximately 25° C. Alternatively, the normal waiting temperature could be a medium waiting temperature which is approximately 80° C. After the fixing device reaches the high waiting temperature, the temperature of the fixing device is raised to the fixing temperature of approximately 250° C. when a signal is received to start an image forming operation. The signal to start an image forming operation is generated when a person presses a key to start a copying operation, a signal to begin printing is received, an incoming facsimile is received, a facsimile transmission report needs to be generated, or at any other desired time.

When the fixing operation ends and thus the image forming operation ends, after five minutes of inactivity, the temperature of the fixing device drops from the high waiting temperature to the low waiting temperature. According to the first embodiment, the five minutes of inactivity means that no images have been printed or fixed for the last five minutes and that no keys have been pressed for the last five minutes. This five minute time period is only an exemplary time period and other time periods may be used with the invention.

If a key is pressed when the image forming device is at the normal waiting temperature, the temperature of the fixing device will rise to the high waiting temperature. However, if no keys of the image forming device are pressed or no image is printed on the image forming device, the temperature of the fixing device returns to the normal waiting temperature five minutes after the last key was pressed (e.g., the key which caused the temperature to rise from the normal waiting temperature to the high waiting temperature).

According to a second embodiment of the invention, the temperature is raised from the normal temperature to the high waiting temperature in response to a key operation related to image forming. For example, if the key which is pressed is related to a copying operation such as the number of copies, image density, the start or copy key, a magnification key, a paper size selection key, or a key related to another parameter used in copying or printing, the temperature of the fixing device will be raised to the high waiting temperature. If the key which is pressed is related to an operation which is not used to immediately print a document, for example, keys related to a scanning operation including a scan/start key or any other key related to functions performed by a scanner when no images will be immediately printed or printed in response to the scanning operation, or a key related to a facsimile transmission operation such as the keying in of a phone number or alternative manner of recalling a phone number, or other parameters related to a facsimile transmission including the key which causes the facsimile transmission or the setting of the transmission mode, the temperature does not change from the low waiting temperature to the high waiting temperature.

When lowering the temperature of the fixing device according to the second embodiment of the invention, when a key is pressed, a timer used to determine a predetermined period of time of inactivity is reset only when the key operation relates to the image forming operation. If a key is pressed related to a facsimile or scanning operation, the temperature of the fixing device will drop from the high waiting temperature to the normal waiting temperature without regard to whether a key was pressed for a facsimile transmission operation or a scanning transmission operation, for example.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 3B(1) and 3B(2) are a flowchart illustrating a process of lowering the temperature of the fixing device in accordance with the first embodiment of the invention;

FIGS. 5B(1) and 5B(2) are a flowchart illustrating a process of lowering the temperature of the fixing device in accordance with the second embodiment of the invention.

DESCRIPTION OF THE PREFERRED EMBODIMENTS

Figure 1:
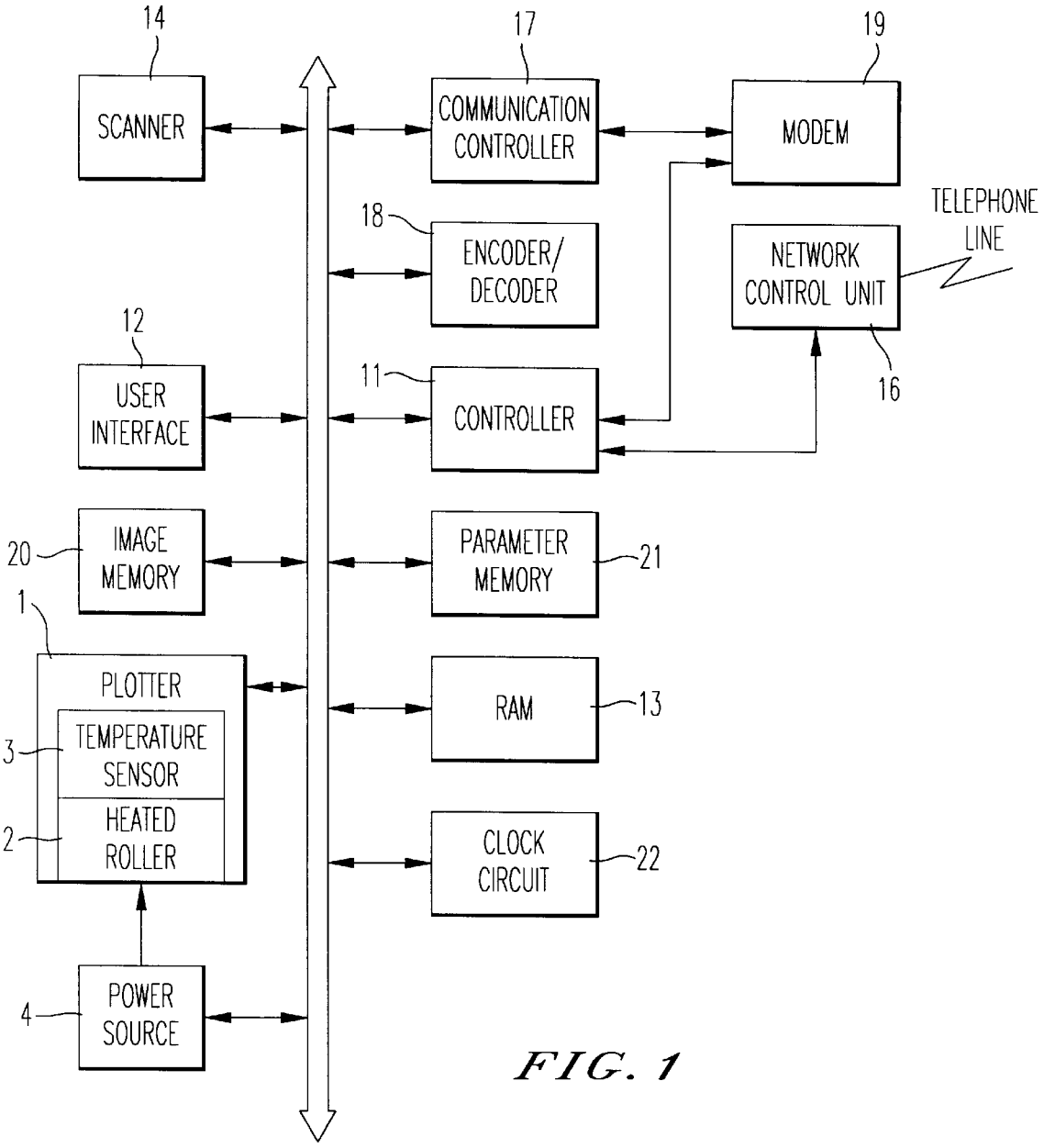
FIG. 1 is a diagram of exemplary hardware utilized to implement the invention.

Referring now to the drawings, wherein like reference numerals designate identical or corresponding parts throughout the several views, and more particularly to FIG. 1 thereof, there is illustrated a block diagram of an image recording apparatus, also referred to as an image recording device or apparatus, implemented as a multifunction machine including a facsimile function, a copying function, a printing function, and a scanning function, for example. The image recording apparatus includes a plotter 1, also referred to as a printer, implemented as an electrophotographic recording apparatus which prints out received image information encoded by an encoder/decoder 18 on a recording paper through the use of a RAM 13. There is a heated roller 2 within the plotter 1, a temperature sensor 3 which detects the temperature around the heated roller 2, and a power source 4 implemented as an electric power supply which supplies electric power to the heated roller and other components of the image recording apparatus. As an alternative to the heated roller 2, any other suitable heated fixing device may be utilized. For example, as an alternative to a heating element being a part of the heated roller 2, the heating element may constitute a separate component.

The image recording apparatus further includes a controller 11, which may be implemented as a programmed microprocessor or control board, for example, which controls and manages the image recording apparatus in accordance with an internal control program, for example. A user interface 12 includes a display and keypad for a user to enter instructions relating to a facsimile, printing, copying, or scanning operation. The keypad of the user interface 12 includes keys or buttons related to both an image forming operation and a non-image forming operation. Keys which relate to an image forming operation include a key to start a copying operation, a magnification key, a paper size selection key or a key related to other parameters used during a copying or printing operation. Keys which are not related to an image forming operation at the image forming device include keys related to facsimile and scanning operations which do not result in an immediate printing of an image. The apparatus also includes a scanner 14, which reads an image of the page, a network control unit (NCU) 16 which controls connection with a remote facsimile through a public telephone line, a communication controller 17 which carries out reception and transmission of a facsimile in accordance with a G3 transmission control process, for example, a modem 19 which includes a low speed and a high speed operation mode, an image memory 20 for storing image information, a parameter memory 21 which stores controlling information such as the predetermined period of time(s) related to temperature control and includes a back-up battery for supplying electric power, and a clock circuit 22 which outputs the present time and acts as a timer.

The controller 11 which is implemented using a microprocessor or any other suitable controlling mechanism detects the occurrence of various events such as a key operation and thus includes an event detecting means for detecting the occurrence of these events such as key operations. The controller 11 also includes at least a part of a measuring means which measures the elapsed time since a key operation detected by the event detecting means, a judging means for judging elapsed time in order to determine whether a predetermine time has elapsed, a temperature setting means for changing the temperature of the heated roller to a low temperature mode when the elapsed time reaches the predetermined time during which there is no occurrence of a recording operation, and a time setting means for setting the predetermine time beforehand. The above-mentioned phenomenon detecting means implemented using the controller 11 includes an input port for latching an input signal from the keypad of the user interface 12, a CPU and a ROM which stores the computer program. The measuring means, the judging means for judging elapsed time, the temperature setting means and the time setting means also comprise a CPU and a ROM which stores a program. The measuring means also includes the clock circuit 12.

Figure 2A:
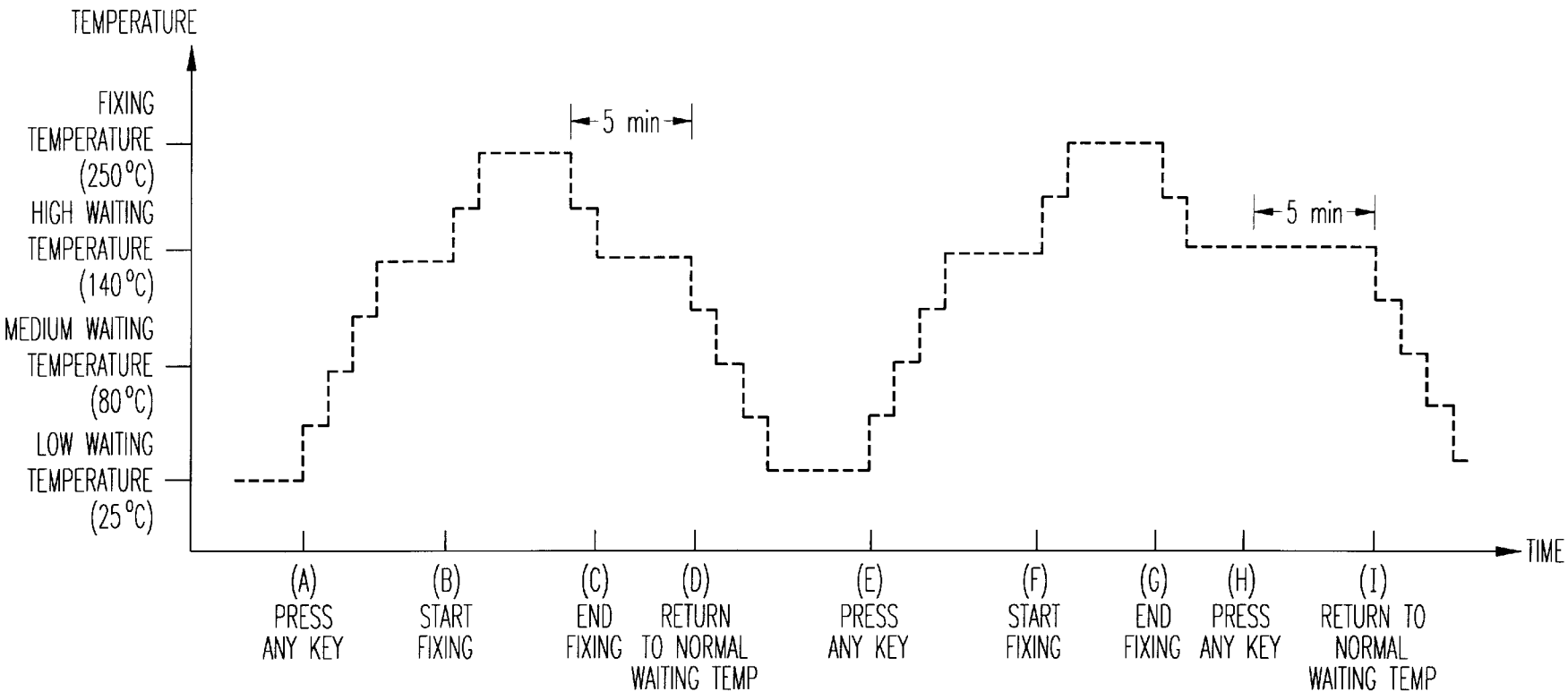
FIGS. 2A and 2B are timing diagrams which are utilized with the first embodiment of the invention.
Figure 2B:
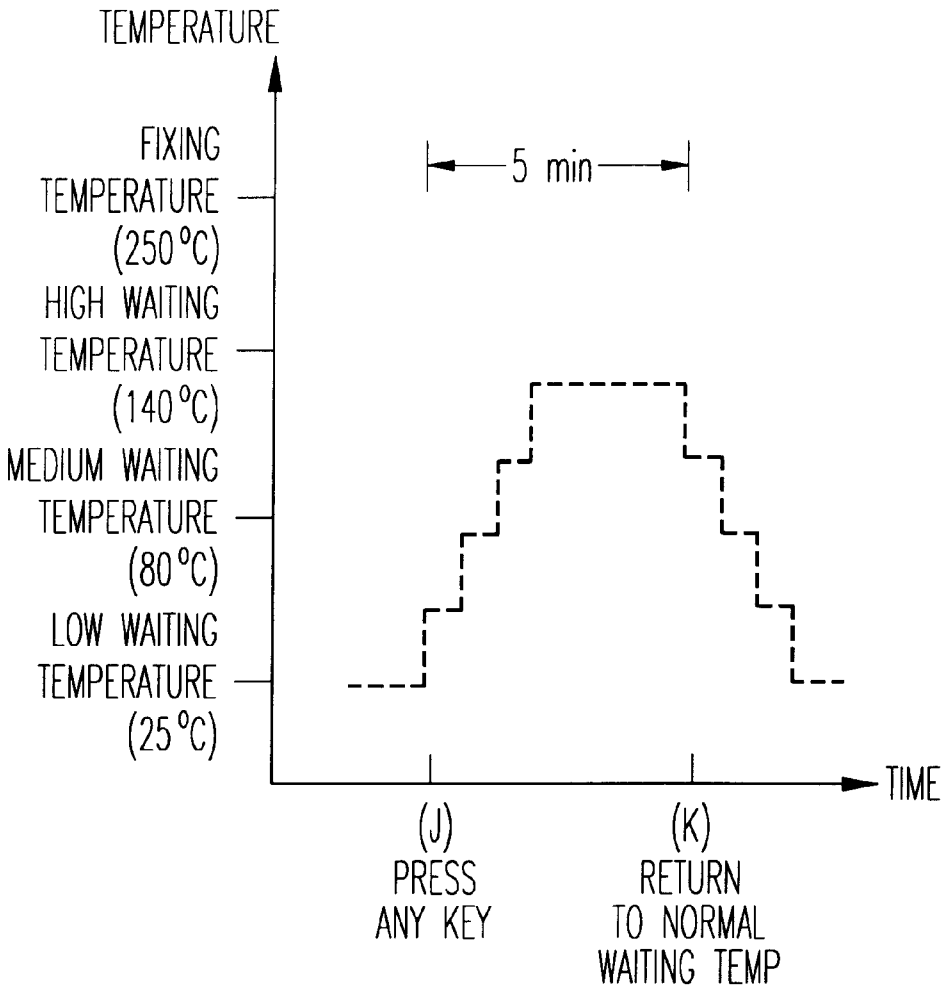

FIGS. 2A and 2B illustrate a timing diagram of the temperature of the fixing device over time for the first embodiment of the invention. In FIGS. 2A and 2B (and also 4A and 4B) the normal waiting temperature is illustrated as being the low waiting temperature of 25° C. However, as an alternative to the normal waiting temperature being the low waiting temperature, the normal waiting temperature can be any desired waiting temperature including the medium waiting temperature of 80° C.

In FIG. 2A, at time (A), the temperature of the fixing device is at the low waiting temperature and the user presses any key of an image forming device. This causes the temperature to rise to the high waiting temperature which is preferably 140° C. At time (B) which is before a predetermined period of time expires such as within 5 minutes of any key being pressed, a signal is given to start an image forming operation and therefore, the temperature of the fixing device is raised to the fixing temperature which is preferably 250° C. in order to start the fixing operation. At time (C), the image forming operation has ended and thus the fixing operation has ended and the temperature returns to the high waiting temperature. After a predetermined period of inactivity such as five minutes after the image forming operation ends, the temperature of the fixing device returns to the normal waiting temperature at time (D).

At time (E), a user presses any key, at time (F), the image or fixing operation starts, and at time (G), the fixing or image forming operation ends. At time (H), the user presses any key on the image forming device. This key is not the key to start the image forming operation but some other key such as a key to set the darkness or lightness of a printed image, or a key to transmit a facsimile, for example. The pressing of the key at time (H) delays the dropping of the temperature of the fixing device from the high waiting temperature for a predetermined period of time such as five minutes. After this five minute time period expires at time (I), the temperature of the fixing device returns to the normal waiting temperature. It is to be noted that while the time of five minutes is illustrated as an exemplary time, any other suitable time period may be utilized.

FIG. 2B also illustrates a timing diagram of the temperature of the fixing device in accordance with the first embodiment of the invention. At time (J), the user presses any key. However, as no signal to begin an image forming operation is given, five minutes after time (J), the temperature of the fixing device returns to the normal waiting temperature at time (K).

While the fixing temperature, high waiting temperature, medium waiting temperature, and low waiting temperature have been respectively illustrated as 250° C., 140° C., 80° C., and 25° C., any suitable temperatures can be chosen or utilized in order to perform the fixing operation. Preferably, the fixing operation is performed on a toner image which has been formed on a recording medium such as a sheet of paper. However, other fixing mechanisms may be utilized.

Temperature control may be performed by having the controller 11 apply electric power to the heated roller 2. After the heated roller reaches the desired temperature as sensed by the temperature sensor 3, power to the heated roller 2 is cut off or reduced.

Figure 3A:
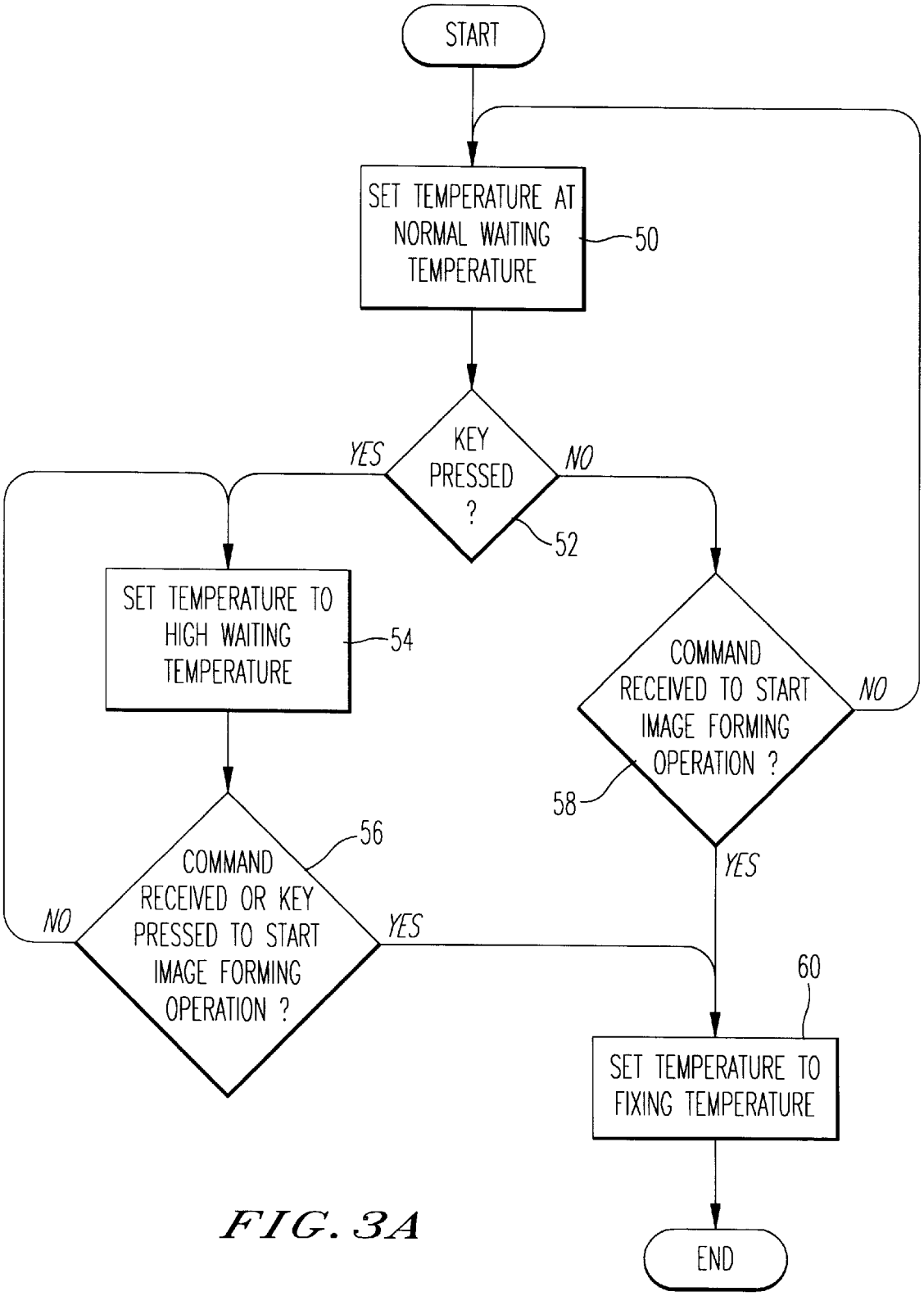
FIG. 3A is a flowchart which illustrates a process of raising the temperature of the fixing device from the normal waiting temperature to the high waiting temperature and ultimately to the fixing temperature in accordance with the first embodiment of the invention.

FIG. 3A illustrates a process of raising the temperature of the fixing device in accordance with the first embodiment of the invention. After starting, the temperature of the fixing device is set at the normal waiting temperature at step 50. Step 52 then determines if any key has been pressed. If a key has been pressed, control proceeds to step 54 which sets the temperature of the fixing device to the high waiting temperature. Thereafter, step 56 examines if a command has been received to start the image forming operation or a key has been pressed to start the image forming operation. Such a command could be a ringing signal on a telephone line on which facsimiles are received, a signal from a printer line which includes information to be printed, or the pressing of a key used to start a copying operation. If step 56 determines that no command to begin an image forming operation has been received or no key has been pressed to start an image forming operation, control returns to step 54 which holds the temperature at the high waiting temperature. Alternatively, if a command has been received or a key has been pressed signaling the start of an image forming operation, the temperature of the fixing device is set to the fixing temperature in step 60 and the process ends.

If step 52 determines that a key has not been pressed, step 58 determines if a command has been received to start an image forming operation. Such a command could be the ringing telephone line on which facsimiles are received or the receipt of information from a printer. If step 58 determines that a command has been received to start an image forming operation, control proceeds to step 60 which sets the temperature of the fixing device at the fixing temperature. Alternatively, if step 58 determines that no command has been received to start an image forming operation, control returns to step 50 which holds the temperature of the fixing device at the normal waiting temperature.

FIGS. 3B(1) and 3B(2) are a flowchart of a process according to the first embodiment of reducing the temperature of the fixing device from the high waiting temperature to the normal waiting temperature. The flowcharts of FIGS. 3A and 3B(1) and 3B(2) illustrate separate processes for raising and lowering the temperature of the fixing device. However, if desired, the processes of raising and lowering the temperature of the fixing device can be combined into a single process.

Before describing the process of lowering the temperature of the fixing device from the high waiting temperature to the normal waiting temperature, an explanation of the utilization of the fixing temperature of the fixing device is set forth. In order to provide optimum energy savings, the temperature of the fixing device is preferably held at the fixing temperature during the image forming and/or fixing operation. As soon as or shortly after the image forming operation or fixing operation ends, the temperature of the fixing device is brought down to the high waiting temperature. When the fixing device is at the high waiting temperature and a signal is given to begin an image forming operation, the temperature of the fixing device is changed from the high waiting temperature to the fixing temperature.

Referring to FIG. 3B(1), after starting, step 72 sets the temperature of the heater within the fixing device at the high waiting temperature. In step 74, there is input a time period. If there is inactivity at the image forming device during this time period, when the time period expires, the temperature of the fixing device will be changed from the high waiting temperature to the normal waiting temperature. While step 74 states that the time period is input, this input can be performed by a user of the image forming device using keys or the user interface 12 through a menu, by a service technician, or alternatively input at the place of manufacture of the image forming device for example, in a ROM, or an erasable and reprogrammable memory such as a flash memory. Alternatively, the inputting of the time period may be performed by copying the time period from a location in a memory to a different memory location. After step 74, step 76 sets the present time as the start time. Step 78 then determines if a key has been pressed or an image printed. Step 80 makes a determination, based on the result of step 78, as to whether a key has been pressed or an image printed. If an affirmative response results from step 80, meaning any key has been pressed on the image forming device or an image printed by the image forming device, control proceeds to step 82 which holds the temperature of the heater at the high waiting temperature. Control then returns to step 76 which sets the present time as the start time, thus resetting the timer which times the period of inactivity. If step 80 determines that a key has not been pressed or an image has not been printed, control proceeds to process B illustrated in FIG. 3B(2).

In FIG. 3B(2), step 84 calculates the difference between the start time and the present time based on the time which has been set in step 76 and a running timer. Step 86 determines if the time period of inactivity which was input at step 74 has elapsed. If this time period has elapsed, control proceeds to step 88 which reduces the temperature of the heater to the normal waiting temperature and the process ends. If step 86 determines that the time period of inactivity has not elapsed, control proceeds to step 90 which holds the temperature of the heater of the fixing device at the high waiting temperature and control returns to step 78 of FIG. 3B(1). If step 86 determines that the time period of inactivity has elapsed, the temperature of the fixing device is reduced to the normal waiting temperature in step 88 and the process of FIGS. 3B(1) and 3B(2) ends.

FIGS. 4A–5B(2) are directed toward a second embodiment of the invention. The second embodiment of the invention is similar to the first embodiment of the invention except that instead of performing a temperature change when any key is pressed or monitoring whether any key is pressed, the second embodiment monitors whether a key related to an image forming operation has been pressed. Keys related to an image forming operation include any keys which alter the parameters of the image forming process and keys which control the image forming process such as a key which commands the start of an image forming operation which may be a copy key. A key or button on the user interface which is used to input a telephone number to which a facsimile is transmitted or a key which is used to control a stand-alone scanning operation which does not result in the immediate printing of an image are keys which do not relate to an image forming operation. It is also possible to have keys which, depending on the mode of the image forming apparatus, relate to both an image forming operation and a non-image forming operation. The type of these keys relate to the mode of the image forming apparatus. For example, the number keys relate to an image forming operation when used to indicate a number of copies and do not relate to an image forming apparatus when used to enter a phone number.

Figure 4A:
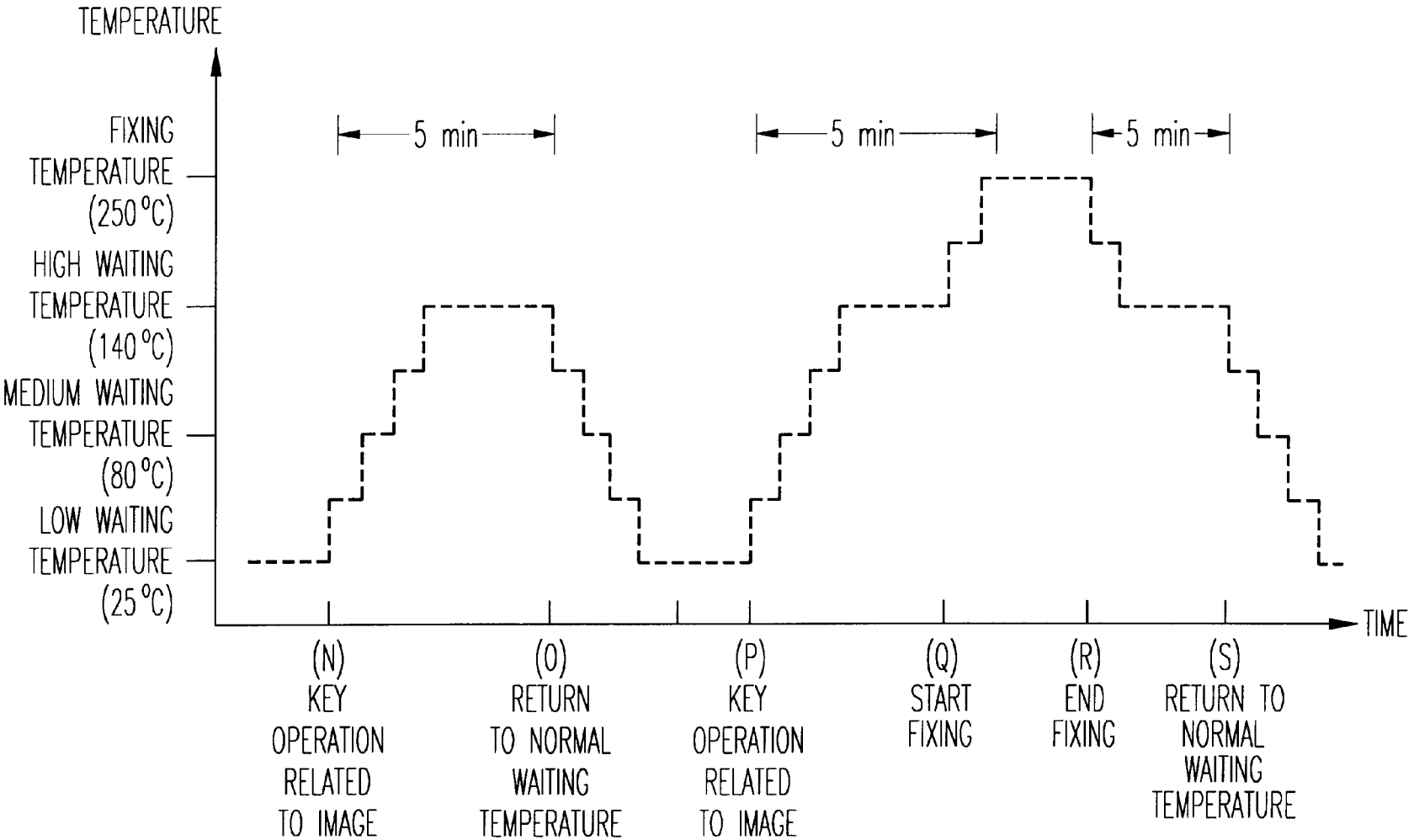
FIGS. 4A and 4B are timing diagrams which are utilized with the second embodiment of the invention.
Figure 4B:
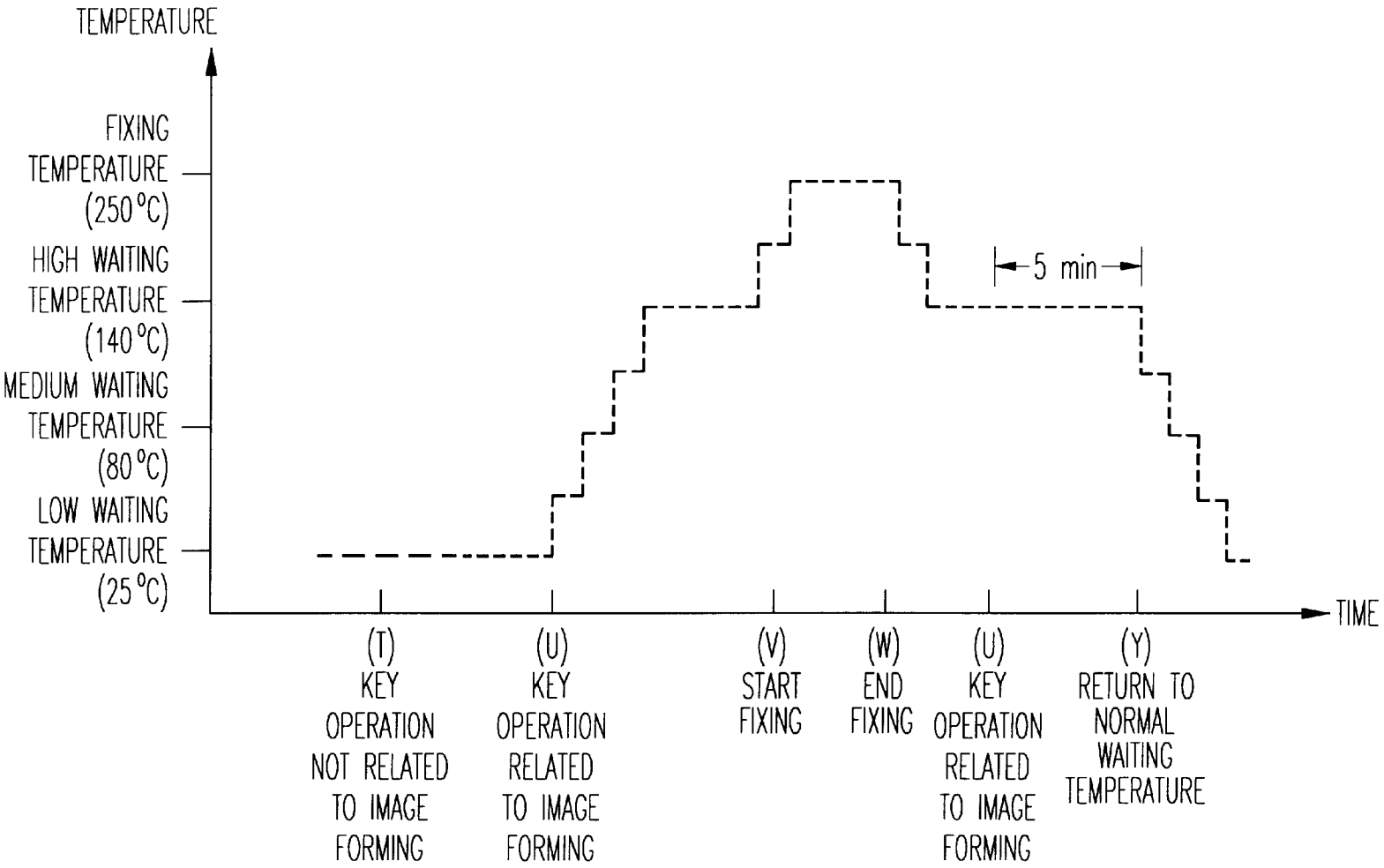

FIGS. 4A and 4B are timing diagrams of the temperature of the fixing device over a period of time in accordance with the second embodiment. In FIG. 4A, at time (N), there is a key operation which relates to an image forming operation. As explained above, such a key operation includes pressing a key which starts an image forming operation, or a key which controls or changes the parameters of the image forming operation such as a key related to setting of the darkness or density of the generated image, a key related to the number of copies which are made, a key related to the magnification, or a key related to the paper tray selection, for example. After a predetermined period of time after time (N), such as five minutes, there has been no image forming activity or no subsequent key operation related to an image forming operation. Thus, at time (O), the temperature of the fixing device returns to the normal waiting temperature.

Also in FIG. 4A, at time (P), there is a key operation related to an image forming operation. Within five minutes of time (P), an image forming operation begins and the fixing of the image at the fixing temperature of 250° C. begins at time (Q) and ends at time (R). Five minutes after the end of the fixing operation, five minutes being a predetermined period of time, as there was no image forming activity nor any keys pressed related to an image forming operation, the temperature of the fixing device returns to the normal waiting temperature at time (S).

In FIG. 4B, at time (T), there is a key operation but the key which is pressed is not related to an image forming operation. Such a key operation could be the entering of a telephone number to which a facsimile is to be transmitted, another key pressed related to a facsimile transmission, or a key related to a scanning operation which does not immediately result in the generation of an image. As the key operation is not related to the forming of an image, the temperature of the fixing device remains at the normal waiting temperature which is, for example, the low waiting temperature.

Subsequent to time (T), there is a key operation related to an image forming process at time (U) and the temperature of the fixing device is raised to the high waiting temperature. From time (V) to time (W), there is an image forming operation during which the fixing operation occurs. During this time, the temperature of the fixing device is at the fixing temperature. At time (X), there is a key pressed related to an image forming operation. Thus, a timer is reset and after a predetermined period of time such as five minutes, at time (Y) the temperature of the fixing device returns to the normal waiting temperature. The normal waiting temperature is preferably the low waiting temperature but alternatively can be the medium waiting temperature.

Figure 5A:
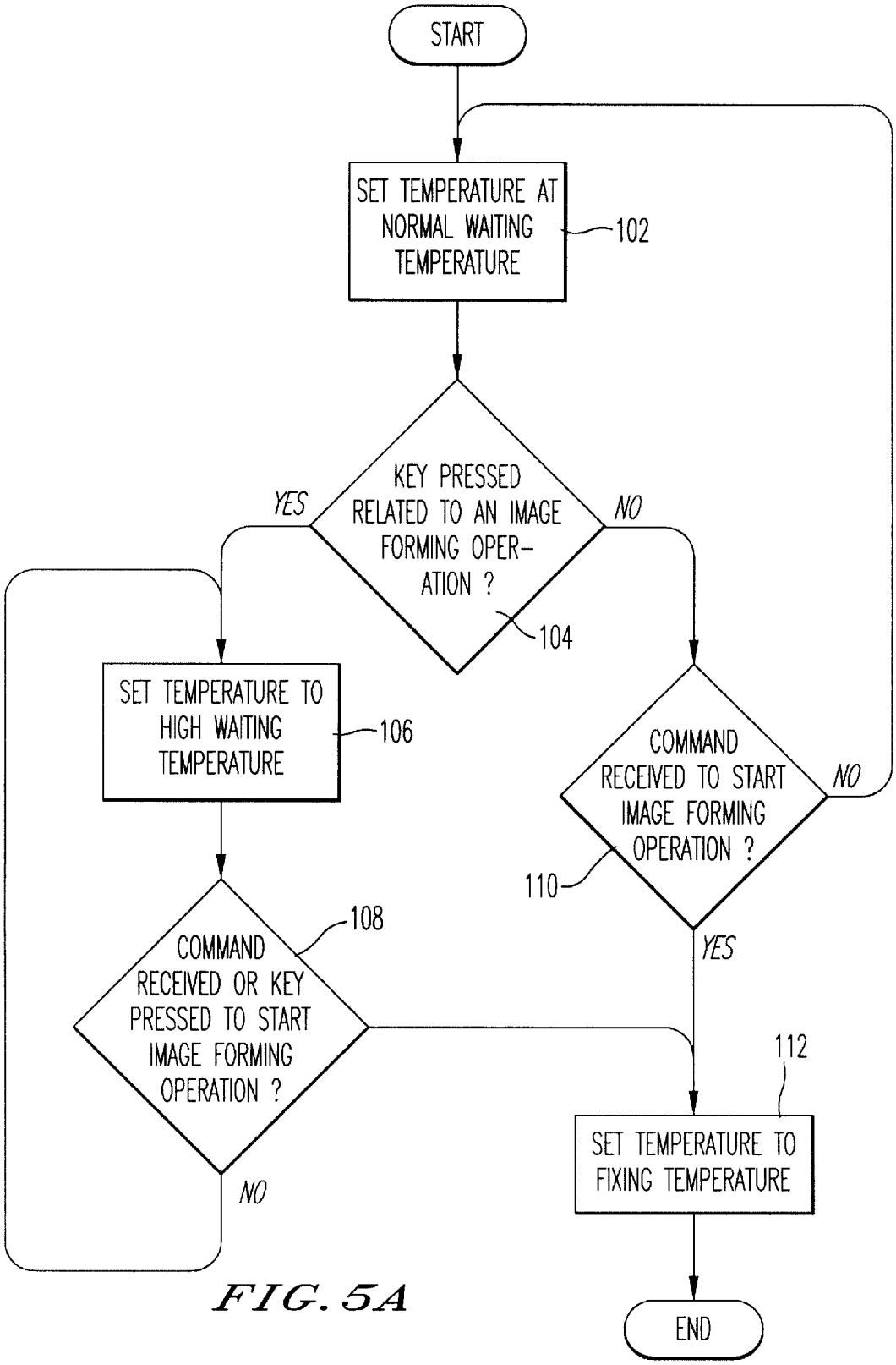
FIG. 5A is a flowchart which illustrates a process of raising the temperature of the fixing device from the normal waiting temperature to the high waiting temperature and ultimately to the fixing temperature in accordance with the second embodiment of the invention.

FIG. 5A illustrates a flowchart according to the second embodiment of the invention for raising the temperature of the fixing device from the normal waiting temperature to the high waiting temperature and ultimately to the fixing temperature. FIG. 5A is identical to FIG. 3B except for step 104 so only a description of step 104 is provided. According to the second embodiment of the invention, the monitoring of a key being pressed determines whether the key is related to an image forming operation. As explained above, these keys relate to the start and control of the image forming process including the control and changing of the parameters of the image forming operation. If a key is pressed which is related to an image forming operation, control proceeds from step 104 to step 106. If no key has been pressed related to an image forming operation, control passes from step 104 to step 110. As the remainder of the flowchart illustrated in FIG. 5A is identical to FIG. 3A, a description of these steps is not provided and the description of FIG. 3A should be used for reference.

FIGS. 5B(1) and 5B(2) illustrate the process of the second embodiment of the invention for lowering the temperature of the heater of the fixing device from the high waiting temperature to the normal waiting temperature. After starting, step 120 sets the temperature of the heater at the high waiting temperature. In step 122, the time period of inactivity which activates the normal waiting temperature mode is input. As described with respect to FIG. 3B(1), this temperature is input by a user, by a service technician, or programmed at the factory or place of manufacture, for example. Step 124 then sets the present time as the start time. Subsequently, step 126 determines if a key has been pressed or an image printed. If it has been determined that an image has been printed, flow proceeds from step 128 to step 132 which holds the temperature of the heater at the high waiting temperature. If no image has been determined to be printed, control proceeds from step 128 to step 130 which determines if a key has been pressed related to an image forming operation. If such a key has been pressed, control proceeds from step 130 to step 132 which holds the temperature of the heater at the high waiting temperature. Thereafter, control proceeds to step 124. If step 130 does not determine that a key has been pressed related to an image forming operation, control proceeds to process D illustrated in FIG. 5B(2). As the steps of FIG. 5B(2) are identical to the steps of FIG. 3B(2), a description of the operation of this flowchart is omitted.

As an alternative to or in addition to the first and second embodiments described above, it is also possible for the temperature of the fixing device to be raised to the fixing temperature as soon as a key is pressed. As a further alternative, the temperature will immediately be raised to the fixing temperature when a key is pressed related to an image forming operation.

While the invention has been described using one predetermined period of time, it is possible to use a plurality of time periods. For example, one time period may be used with respect to when an image forming operation last occurred and another time period used with respect to measuring when a key was last pressed.

This invention may be conveniently implemented using a conventional general purpose digital computer or microprocessor programmed according to the teachings of the present specification, as will be apparent to those skilled in the computer art. Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art.

The present invention includes a computer program product which is a storage medium including instructions which can be used to program a computer to perform a process of the invention. The storage medium can include, but is not limited to, any type of disk including floppy disks, optical discs, CD-ROMs, and magneto-optical disks, ROMs, RAMs, EPROMs, EEPROMs, magnetic or optical cards, or any type of media suitable for storing electronic instructions.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A method of controlling a temperature of a fixing device of an image forming device, comprising the steps of:

setting the temperature of the fixing device at a first temperature;

determining whether a key of the image forming device has been pressed;

determining whether an image has been generated by the image forming device;

reducing a temperature of the fixing device from the first temperature to a second temperature lower than the first temperature when a key of the image forming device has not been pressed for a first predetermined period of time and when an image has not been generated for a second predetermined period of time.

2. A method according to claim 1, further comprising the steps of:

starting a timer;

resetting the timer when a key of the image forming device has been pressed; and resetting the timer when an image has been generated by the image forming device, wherein the step of reducing the temperature is performed when the first predetermined period of time expires and when the second predetermined period of time expires.

3. A method according to claim 2, wherein the reducing step comprises:

reducing the temperature of the fixing device from the first temperature to the second temperature when a key of the image forming device has not been pressed for the first predetermined period of time and when an image has not been generated for the second predetermined period of time, the second predetermined period of time being the same as the first predetermined period of time.

4. A method according to claim 1, further comprising the step of:

holding the fixing temperature at the first temperature when a key has been pressed or when an image has been printed, before the predetermined period of time expires.

5. A method according to claim 1, further comprising the step of:

inputting the predetermined period of time.

6. A method according to claim 5, wherein the inputting step comprises:

inputting by a user the predetermined period of time.

7. A method according to claim 1, wherein the step of determining whether a key has been pressed comprises:

determining whether the key of the image forming device which has been pressed is used to start or control the image forming device, wherein the step of reducing the temperature comprises:

reducing the temperature of the fixing device from the first temperature to the second temperature when a key of the image forming device which is used to start or control an image forming operation of the image forming device has not been pressed for the first predetermined period of time and when an image has not been generated for the second predetermined period of time.

8. A method according to claim 1, further comprising the step of:

raising the temperature of the fixing device from the second predetermine temperature to the first predetermined temperature in response to a key of the image forming device being pressed.

9. A method according to claim 8, wherein the step of raising the temperature comprises:

raising the temperature of the fixing device from the second predetermine temperature to the first predetermined temperature in response to a key of the image forming device being pressed which is selected from a group of keys used to start or control an image forming operation of the image forming device.

10. A method of controlling a temperature of a fixing device of an image forming device, comprising the steps of:

setting the temperature of the fixing device of the image forming device at a first temperature;

determining whether a key has been pressed which is used to start or control the image forming apparatus;

raising the temperature of the fixing device to a second temperature which is higher than the first temperature in response to a key being pressed which is selected from a group consisting of keys used start or control an image forming operation of the image forming device, the method further comprising the steps of:

determining whether a signal has been received commanding a start of the image forming operation;

raising the temperature of the fixing device from the second temperature to a third temperature which is higher than the second temperature and is a temperature used to fix an image on a recording medium, when the signal has been received commanding a start of the image forming operation.

11. An apparatus for controlling a temperature of a fixing device of an image forming device, comprising:

means for setting the temperature of the fixing device at a first temperature;

means for determining whether a key of the image forming device has been pressed;

means for determining whether an image has been generated by the image forming device;

means for reducing a temperature of the fixing device from the first temperature to a second temperature lower than the first temperature when a key of the image forming device has not been pressed for a first predetermined period of time and when an image has not been generated for a second predetermined period of time.

12. An apparatus according to claim 11, further comprising:

a timer;

means for starting the timer;

means for resetting the timer when a key of the image forming device has been pressed; and means for resetting the timer when an image has been generated by the image forming device, wherein the means for reducing the temperature is performed when the first predetermined period of time expires and when the second predetermined period of time expires.

13. An apparatus according to claim 12, wherein the means for reducing comprises:

means for reducing the temperature of the fixing device from the first temperature to the second temperature when a key of the image forming device has not been pressed for the first predetermined period of time and when an image has not been generated for the second predetermined period of time, the second predetermined period of time being the same as the first predetermined period of time.

14. An apparatus according to claim 11, further comprising:

means for holding the fixing temperature at the first temperature when a key has been pressed or when an image has been printed, before the predetermined period of time expires.

15. An apparatus according to claim 11, further comprising:

means for inputting the predetermined period of time.

16. An apparatus according to claim 15, wherein the means for inputting comprises:

means for inputting by a user the predetermined period of time.

17. An apparatus according to claim 11, wherein the means for determining whether a key has been pressed comprises:

means for determining whether the key of the image forming device which has been pressed is used to start or control the image forming device, wherein the means for reducing the temperature comprises:

means for reducing the temperature of the fixing device from the first temperature to the second temperature when a key of the image forming device which is used to start or control an image forming operation of the image forming device has not been pressed for the first predetermined period of time and when an image has not been generated for the second predetermined period of time.

18. An apparatus according to claim 11, further comprising:

means for raising the temperature of the fixing device from the second predetermine temperature to the first predetermined temperature in response to a key of the image forming device being pressed.

19. An apparatus according to claim 18, wherein the means for raising the temperature comprises:

means for raising the temperature of the fixing device from the second predetermine temperature to the first predetermined temperature in response to a key of the image forming device being pressed which is selected from a group of keys used to start or control an image forming operation of the image forming device.

20. An apparatus of controlling a temperature of a fixing device of an image forming device, comprising:

means for setting the temperature of the fixing device of the image forming device at a first temperature;

means for determining whether a key has been pressed which is used to start or control the image forming apparatus;

means for raising the temperature of the fixing device to a second temperature which is higher than the first temperature in response to a key being pressed which is selected from a group consisting of keys used start or control an image forming operation of the image forming device;

means for determining whether a signal has been received commanding a start of the image forming operation;

means for raising the temperature of the fixing device from the second temperature to a third temperature which is higher than the second temperature and is a temperature used to fix an image on a recording medium, when the signal has been received commanding a start of the image forming operation.

21. A method of controlling a temperature of a fixing device of an image forming device, comprising the steps of:

setting the temperature of the fixing device of the image forming device at a first temperature;

determining whether a key has been pressed which is used to set a parameter of the image forming device related to an image forming operation of the image forming device;

raising the temperature of the fixing device to a second temperature which is higher than the first temperature in response to said key being pressed which is used to set a parameter of the image forming device;

determining whether a key has been pressed which does not relate to setting of a parameter of the image forming device related to an image forming operation of the image forming device and also does not relate to a command to start an image forming operation within said image forming device; and maintaining a temperature of the fixing device at the first temperature in response to said key being pressed which does not relate to a setting of the parameter of the image forming device related to an image forming operation, and also does not relate to a command to start an image forming operation within said image forming device.

22. A method according to claim 21, wherein:

the determining step which is used to determine whether a parameter of the image forming device is set comprises determining whether the key which has been pressed includes a magnification key.

23. A method according to claim 21, wherein:

the determining step which is used to determine whether a parameter of the image forming device is set comprises determining whether the key which has been pressed includes a paper size selection key.

24. A method according to claim 21, wherein:

the determining step which is used to determine whether a parameter of the image forming device is set comprises determining whether the key which has been pressed includes at least one key to set a lightness and darkness of an image which is formed.

25. A method of controlling a temperature of a fixing device of an image forming device, comprising the steps of:

setting the temperature of the fixing device of the image forming device at a first temperature;

determining whether a key has been pressed which is used to set a parameter of the image forming device related to an image forming operation of the image forming device;

raising the temperature of the fixing device to a second temperature which is higher than the first temperature in response to said key being pressed which is used to set a parameter of the image forming device;

determining whether a key to start an image forming operation has been pressed; and raising the temperature of the fixing device to a temperature which is higher than the first temperature in response to said key to start an image forming operation being pressed.

26. A method according to claim 25, wherein:

said step of raising the temperature of the fixing device in response to said key to start an image forming operation being pressed comprises raising the temperature of the fixing device to a third temperature which is higher than said first and second temperatures.

27. A system for controlling a temperature of a fixing device of an image forming device, comprising:

means for setting the temperature of the fixing device of the image forming device at a first temperature;

means for determining whether a key has been pressed which is used to set a parameter of the image forming device;

means for raising the temperature of the fixing device to a second temperature which is higher than the first temperature in response to said key being pressed which is used to set a parameter of the image forming device;

means for determining whether a key has been pressed which does not relate to setting of a parameter of the image forming device related to an image forming operation of the image forming device and also does not relate to a command to start an image forming operation within said image forming device; and means for maintaining a temperature of the fixing device at the first temperature in response to said key being pressed which does not relate to a setting of the parameter of the image forming device related to an image forming operation, and also does not relate to a command to start an image forming operation within said image forming device.

28. A system according to claim 27, wherein:

the means for determining whether a key has been pressed which is used to set a parameter comprises means for determining whether the key which has been pressed includes a magnification key.

29. A system according to claim 27, wherein:

the means for determining whether a key has been pressed which is used to set a parameter comprises means for determining whether the key which has been pressed includes a paper size selection key.

30. A system according to claim 27, wherein:

the means for determining whether a key has been pressed which is used to set a parameter comprises means for determining whether the key which has been pressed includes at least one key to set a lightness and darkness of an image which is formed.

31. A system for controlling a temperature of a fixing device of an image forming device, comprising:

means for setting the temperature of the fixing device of the image forming device at a first temperature;

means for determining whether a key has been pressed which is used to set a parameter of the image forming device;

means for raising the temperature of the fixing device to a second temperature which is higher than the first temperature in response to said key being pressed which is used to set a parameter of the image forming device;

means for determining whether a key to start an image forming operation has been pressed; and means for raising the temperature of the fixing device to a temperature which is higher than the first temperature in response to said key to start an image forming operation being pressed.

32. A system according to claim 31, wherein:

said means for raising the temperature of the fixing device in response to said key to start an image forming operation being pressed comprises means for raising the temperature of the fixing device to a third temperature which is higher than said first and second temperatures.

* * * * *